US011052972B1

(12) United States Patent
Kaldor et al.

(10) Patent No.: US 11,052,972 B1
(45) Date of Patent: Jul. 6, 2021

(54) APPARATUSES FOR ATTACHING A COVER TO A MARINE VESSEL

(71) Applicant: Brunswick Corporation, Mettawa, IL (US)

(72) Inventors: Kyle D. Kaldor, Perham, MN (US); Paul D. Zarn, Henning, MN (US)

(73) Assignee: Brunswick Corporation, Mettawa, IL (US)

( * ) Notice: Subject to any disclaimer, the term of this patent is extended or adjusted under 35 U.S.C. 154(b) by 160 days.

(21) Appl. No.: 16/596,907

(22) Filed: Oct. 9, 2019

(51) Int. Cl.
*B63B 17/02* (2006.01)

(52) U.S. Cl.
CPC ..... *B63B 17/02* (2013.01)

(58) Field of Classification Search
CPC ..... B63B 17/02
See application file for complete search history.

(56) References Cited

U.S. PATENT DOCUMENTS 3,985,380 A * 10/1976 Raivio ..... E05C 19/14 292/69
5,058,652 A * 10/1991 Wheatley ..... B60P 7/04 160/327
5,706,753 A 1/1998 Menne et al.
5,970,904 A 10/1999 Wellen et al.
6,053,558 A 4/2000 Weldy et al.
6,588,361 B2 7/2003 Biedenweg
6,886,489 B2 5/2005 Zarn et al.
7,210,728 B1 5/2007 Gillig
7,341,231 B2 3/2008 Zarn
7,640,882 B2 1/2010 Pamiske
9,079,534 B1 7/2015 Jaziri et al.
9,884,667 B1 2/2018 Zarn et al.
10,300,833 B2 5/2019 Alexander et al.

FOREIGN PATENT DOCUMENTS

DE 3907833 A1 * 9/1990 ..... B60J 7/104

* cited by examiner

*Primary Examiner* — Stephen P Avila
(74) *Attorney, Agent, or Firm* — Andrus Intellectual Property Law, LLP

(57) ABSTRACT

A retainer clip is for attaching a cover to a track member on a marine vessel. The channel has opposing proximal and distal sidewalls, a closed inner end, and an open outer end. The retainer clip has an elongated body having a proximal leg configured for attachment to the cover and an opposite distal leg configured for insertion into the channel. Tensioning the proximal leg in a first tension direction causes the distal leg to pivot in the channel in a first pivot direction and engage with the distal sidewall so as to retain the retainer clip in the channel. Tensioning the proximal leg in a second direction causes the distal leg to pivot in the channel in an opposite, second pivot direction and disengage from the distal sidewall so as to allow the retainer clip to be removed from the channel.

20 Claims, 5 Drawing Sheets

APPARATUSES FOR ATTACHING A COVER TO A MARINE VESSEL

FIELD

The present disclosure relates to apparatuses for attaching a cover to a marine vessel, and more particularly to retainer clips that engage with a track member on the marine vessel to thereby secure the cover to the marine vessel.

BACKGROUND

U.S. Pat. No. 10,300,833 discloses a resilient clip used for covers for equipment. The resilient clip has a portion that can be inserted into a channel on the equipment, a portion that can be attached to a cover, and a portion that can be used to remove the clip from the channel.

U.S. Pat. No. 9,884,667 discloses a water control storage frame system for at least one storage compartment formed in a boat having a deck. The system includes a frame structure rising above the deck of the boat and defining an upper peripheral opening of the at least one storage compartment. The frame structure is provided with an external structure facing away from the at least one storage compartment and configured for preventing water collecting on the deck from entering the at least one storage compartment and directing water from the deck into a drainage area. An internal structure is integrally formed with the external structure, and is configured as a peripheral track structure for receiving and retaining storage items at various locations along the peripheral track structure within the at least one storage compartment.

U.S. Pat. No. 9,079,534 discloses a modular track and cam storage system for marine vessels comprising a track extrusion having a c-channel, and a cam latch assembly comprising a latch, a bolt, and a cam. The cam is substantially rectangular in shape having at least two rounded opposing corners. The cam of the cam latch assembly is configured to be horizontally received in the c-channel of the track extrusion and is configured to be rotated within the c-channel such that the cam is slide-ably engaged with the track extrusion. Manipulating the latch will cause the cam to rotate, in order or manually engage the cam latch assembly with the track extrusion. The cam is capable of being locked within said c-channel by flipping the latch downward about the bolt. The cam latch assembles are attached to a storage accessory such as a storage bag, a trash bag, a cup holder, a basin, a rod holder.

U.S. Pat. No. 7,341,231 discloses an accessory mounting device for securing an accessory to a track. The accessory mounting device includes a slide connector having a first portion that mounts within the track and a second portion that projects outwardly from the track. The accessory mounting device also includes an accessory mounting track member that slides over the second portion of the slide connector.

U.S. Pat. No. 6,053,558 discloses a cover assembly for the cargo area of a vehicle that includes a plurality of rails which can be attached to the walls of a truck bed and a cover having an edge which is engage-able by the rails. The rails are connected together by corner members. The corner members include a locking structure which is inserted into a channel in the rails. The locking mechanism of the corner members engages slots in the rails and secures the rails together. The rails include different structures which engage fasteners on the edges of the cover.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter.

In certain examples disclosed herein, an apparatus is for attaching a cover to a marine vessel. The apparatus has a retainer clip configured for attachment to the cover; and a track member configured for attachment to the marine vessel. The track member has a channel that retains the retainer clip to thereby attach the cover to the marine vessel. The channel has opposing proximal and distal sidewalls, a closed inner end, and an open outer end defining a mouth for receiving the retainer clip. The retainer clip has an elongated body having a proximal leg configured for attachment to the cover and an opposite distal leg configured for insertion into the channel. Tensioning the proximal leg in a first tension direction causes the distal leg to pivot in the channel in a first pivot direction and engage with the distal sidewall so as to retain the retainer clip in the channel. Tensioning the proximal leg in an opposite, second direction causes the distal leg to pivot in the channel in an opposite, second pivot direction and disengage from the distal sidewall so as to allow the retainer clip to be removed from the channel.

In certain examples disclosed herein a retainer clip is for attaching a cover to a marine vessel. The retainer clip has an elongated body having a proximal leg configured for attachment to the cover and an opposite distal leg configured for insertion into a channel of a gunwale track member on the marine vessel. A hook on the distal arm has an outer profile surface configured for engagement with the channel of the gunwale track member. The hook has a free end that is compressible towards the distal arm. An intermediate arm extends from the body between the distal and proximal legs. The intermediate arm is configured for insertion into the channel along with the distal leg. The intermediate arm has a free end that is manually compressible towards the distal leg so as to facilitate insertion and removal of the retaining clip into the channel.

BRIEF DESCRIPTION OF THE DRAWINGS

Examples of marine covers and retainer clips for marine covers are herein disclosed with reference to the following drawing figures. The same numbers are used throughout to reference like features and components.

DETAILED DESCRIPTION

During research and development, the present inventors have determined that it would be desirable to provide an improved system for attaching a boat cover to a marine vessel. In particular, the present inventors have endeavored to provide systems that facilitate efficient connection of the boat cover without the need for fasteners or similar connection features. The present inventors have endeavored to provide manually operable systems that facilitate easy connection and disconnection of the boat cover to and from the marine vessel. The present disclosure resulted from these efforts.

Figure 1:
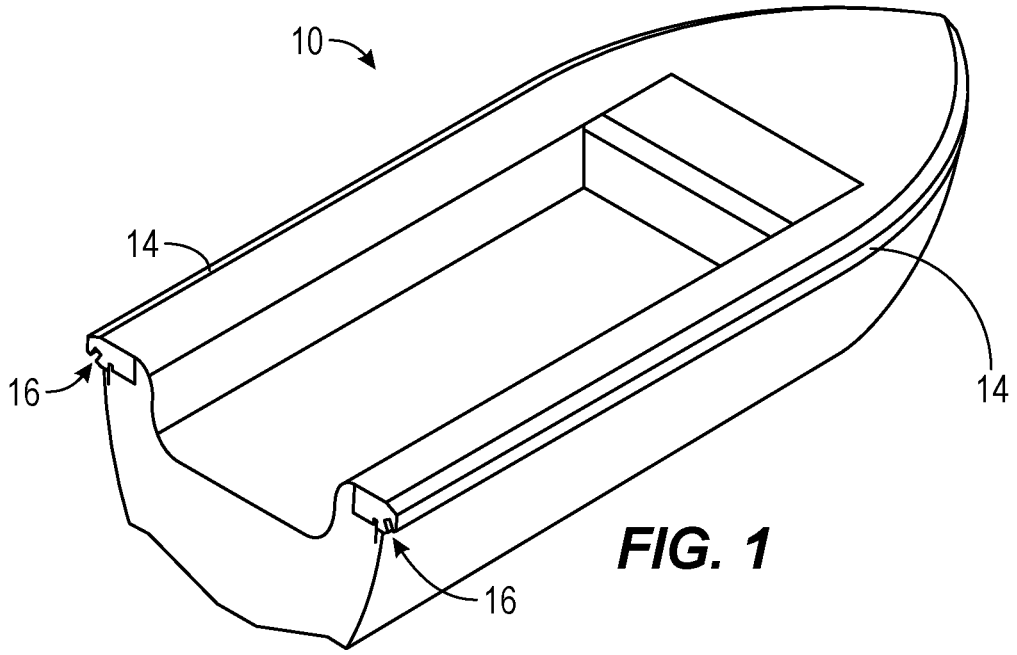
FIG. 1 is a perspective view of a marine vessel having gunwale track members.

FIG. 1 depicts a marine vessel 10, which in this example is a conventional motorboat. The type and configuration of the marine vessel 10 is exemplary and can instead be any other type of watercraft, such as a relatively larger leisure craft, a pontoon boat, a fishing boat, a jet boat, and/or the like. According to the present disclosure, an apparatus for attaching a cover 12 (see FIG. 3) to the marine vessel 10 includes a track member 14, which as shown in FIG. 1 is a gunwale track member; however in other examples the track member can be attached to the marine vessel 10 at other locations. In the illustrated example, the track member 14 is a metal (e.g., aluminum, fiberglass, plastic, composite, and/or the like) extrusion that is elongated along the gunwale of the marine vessel 10. Referring to FIG. 4, the track member 14 has an outwardly facing channel 16 having proximal and distal sidewalls 18, 20 that are connected together by an inner end wall 22. The track member 14 has an open outer end 24, which defines a mouth for receiving a retainer clip 26 that is specially configured according to the present disclosure and further described herein below, in particular for attaching the cover 12 to the marine vessel 10. Retaining tabs 28, 30 are located on the proximal and distal sidewalls 18, 20 at the mouth 24, and extend towards each other and into the mouth 24.

Figure 2:
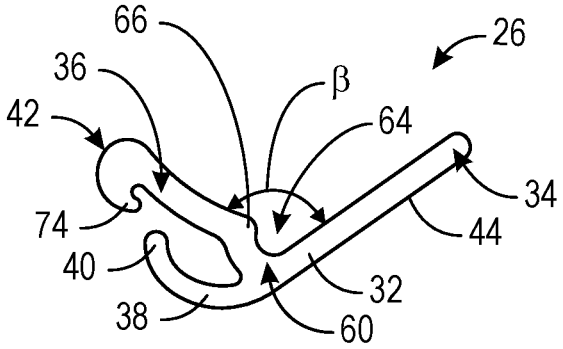
FIG. 2 is an end view of a retainer clip for attaching a cover to the marine vessel via the gunwale track members.
Figure 2A:
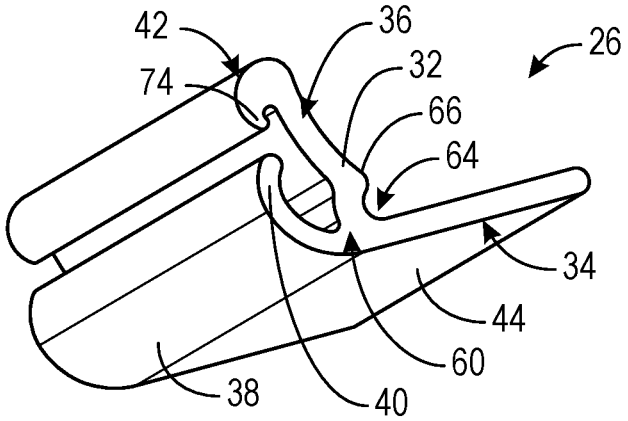
FIG. 2A is a perspective view of the retainer clip.
Figure 3:
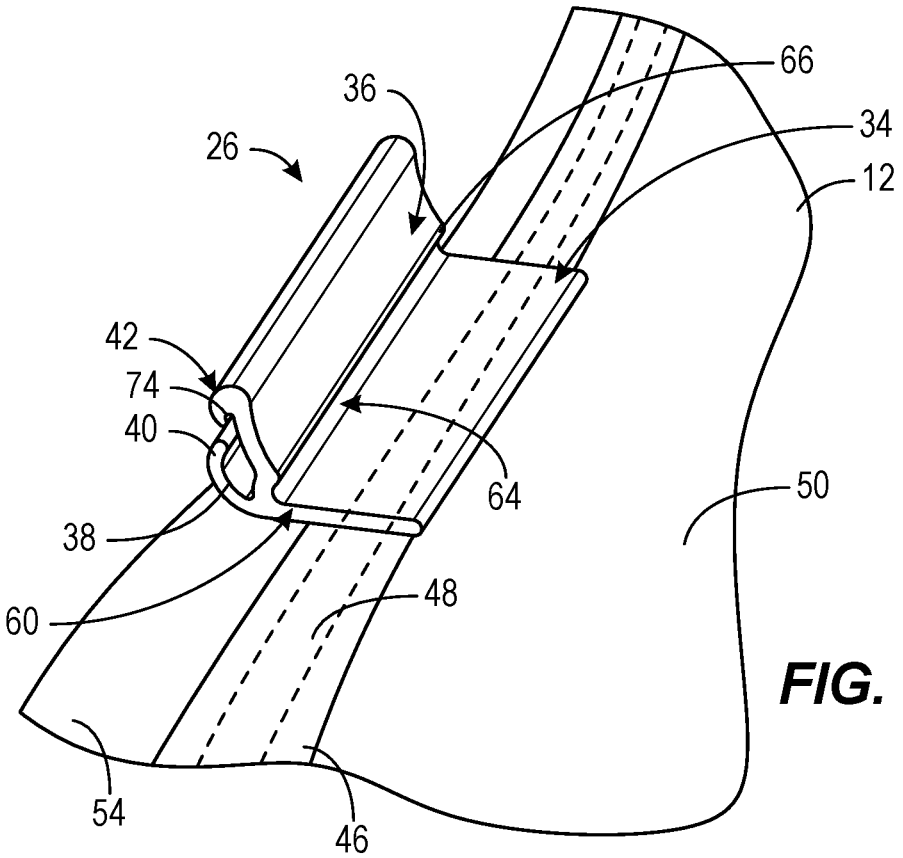
FIG. 3 is a perspective view of the retainer clip attached to the cover.
Figure 4:
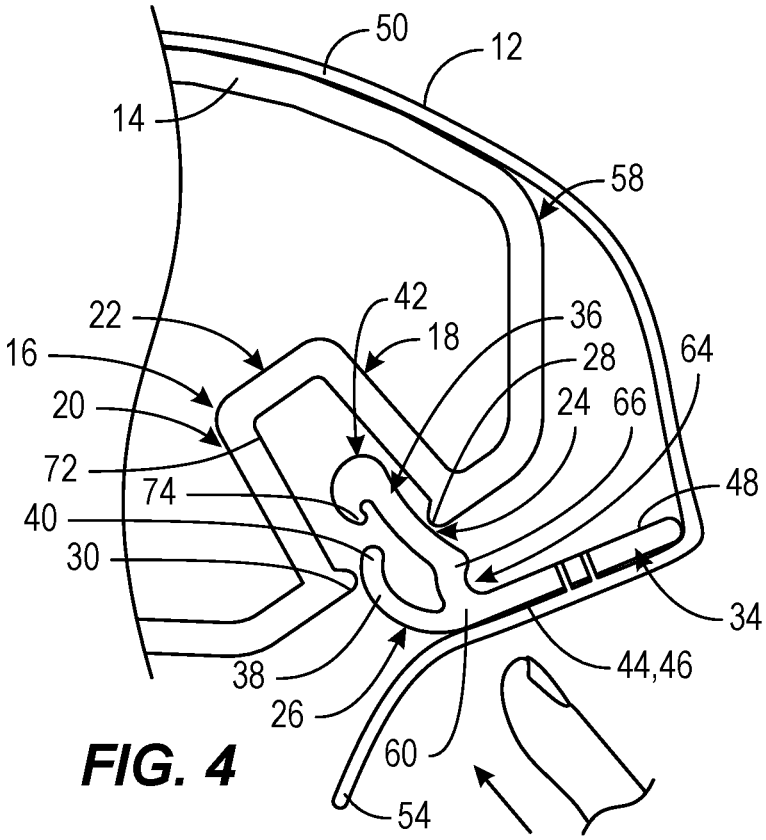
FIG. 4 is a side view of the retainer clip and cover during manual insertion of the retainer clip into a channel on the gunwale track member.

Referring to FIGS. 2-3, the retainer clip 26 can for example be made from a resilient material, such as rubber and/or the like. The retainer clip 26 has an elongated body 32 with a proximal leg 34 configured for attachment to the cover 12 (see FIG. 3), an opposite distal leg 36 configured for insertion into the channel 16, and an intermediate arm 38 that extends from the body 32 between the distal and proximal legs 34, 36, and is configured for insertion into the channel 16 along with the distal leg 36, as is further described herein below with reference to FIGS. 4-9. Referring to FIG. 2, the distal and proximal legs 34, 36 transversely extend relative to each other at an obtuse angle β. The angle β can vary from what is shown. As shown in FIG. 2, the intermediate arm 38 is curved inwardly towards the distal leg 36 and has a free end 40 that is spaced apart from the distal leg 36. A hook 42 is located on the end of the distal leg 36.

Figure 8:
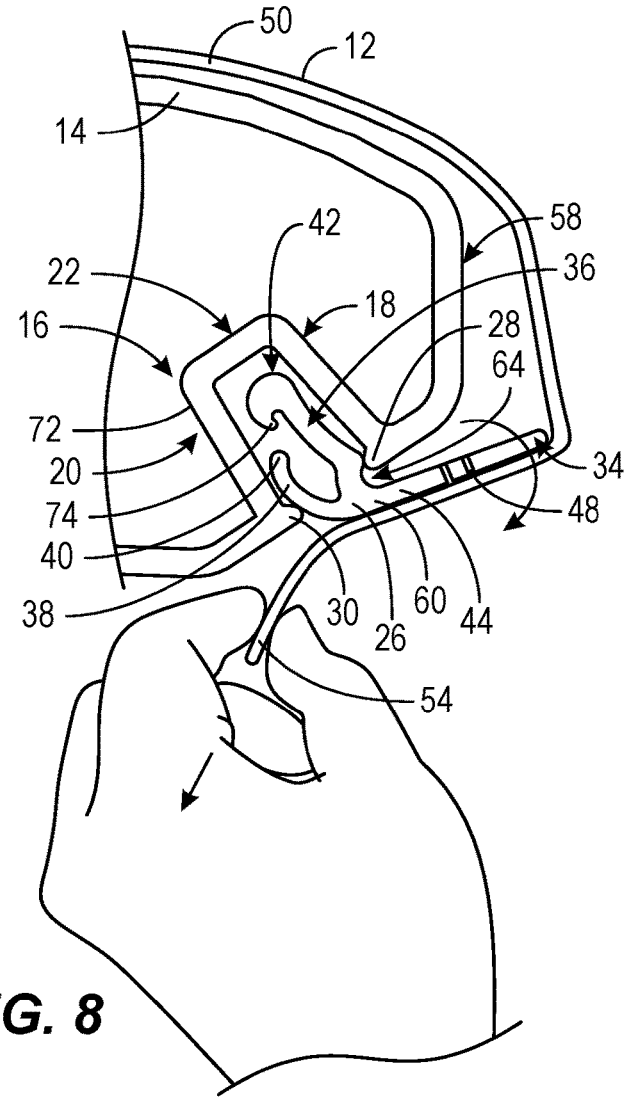
FIG. 8 is a side view during removal of the retainer clip from the channel.
Figure 9:
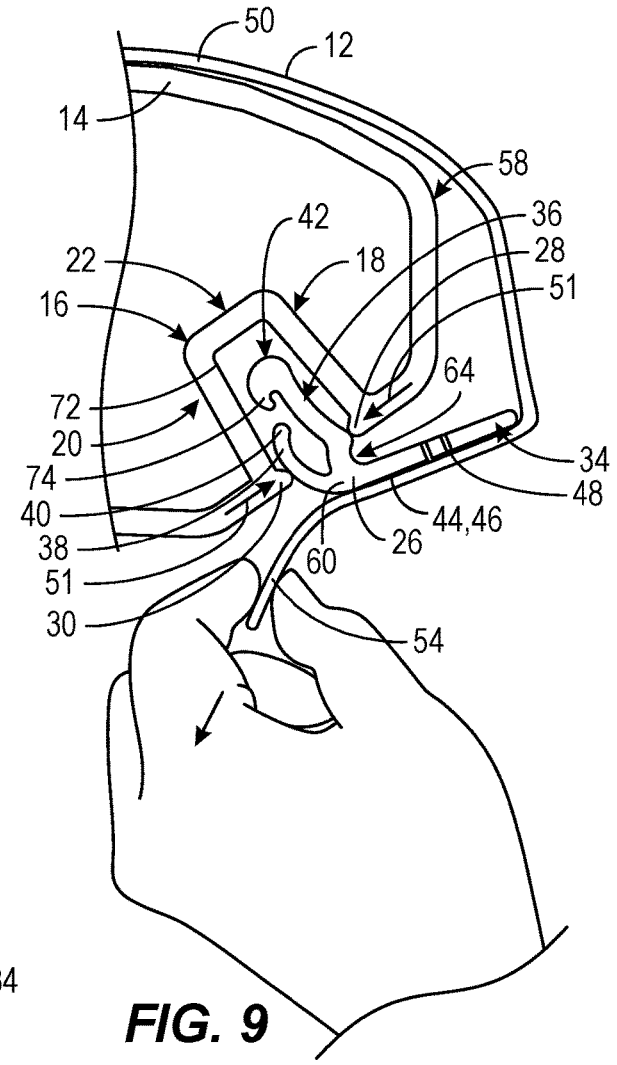
FIG. 9 is a side view of the retainer clip and cover as the retainer clip is further removed from the channel.
Figure 10:
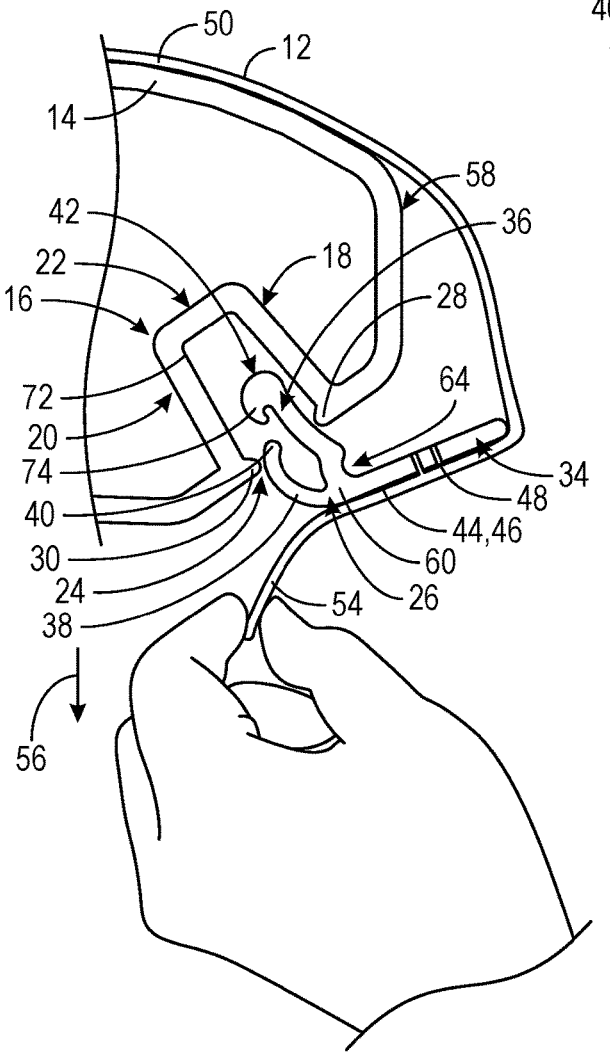
FIG. 10 is a side view of the retainer clip and cover as the retainer clip is removed from the channel, thereby uncoupling the cover from the marine vessel.

Referring to FIG. 3, the retainer clip 26 is one of a plurality of retainer clips (not shown) that are spaced apart from each other and attached to the cover 12 in the manner shown in FIG. 3. FIG. 3 shows only one retainer clip 26; however the other retainer clips in the plurality of similarly constructed, each being configured for manual insertion into the channel 16 for attachment to the track member 14, as will be further described herein below. The manner in which the retainer clip 26 is attached to the cover 12 can vary from what is shown and described. In the illustrated example, the outer surface 44 of the proximal leg 34 of the retainer clip 26 is stitched to the inner surface 46 of the cover 12 by stitching 48. Other means for attaching the retainer clip 26 to the cover 12 can instead be utilized, such as by adhesive and/or the like. In the installed position shown in FIG. 6, a main portion 50 of the cover 12 extends away from the proximal leg 34 in a first tension direction, shown at arrow 52 in FIG. 6. The cover 12 further includes a flap 54 located on the opposite side of the retainer clip 26, and extending away from the proximal leg 34 in a second direction shown at arrow 56, in FIG. 10, which is generally opposite, for example transversely opposite to the first tension direction 52. As will be described further herein below, the flap 54 is configured to facilitate removal of the retainer clip 26 from the channel 16 when it is manually pulled in the second direction 56, as shown in FIGS. 8-10. The track member 14 has a curved outer profile surface 58 extending away from the proximal sidewall 18 and the main portion 50 of the cover 12 is wrapped onto and around the curved outer profile surface 58 when the retainer clip 26 is coupled to the track member 14 and the cover 12 is tensioned in the noted first tension direction 52, as will be further described herein below.

Figure 5:
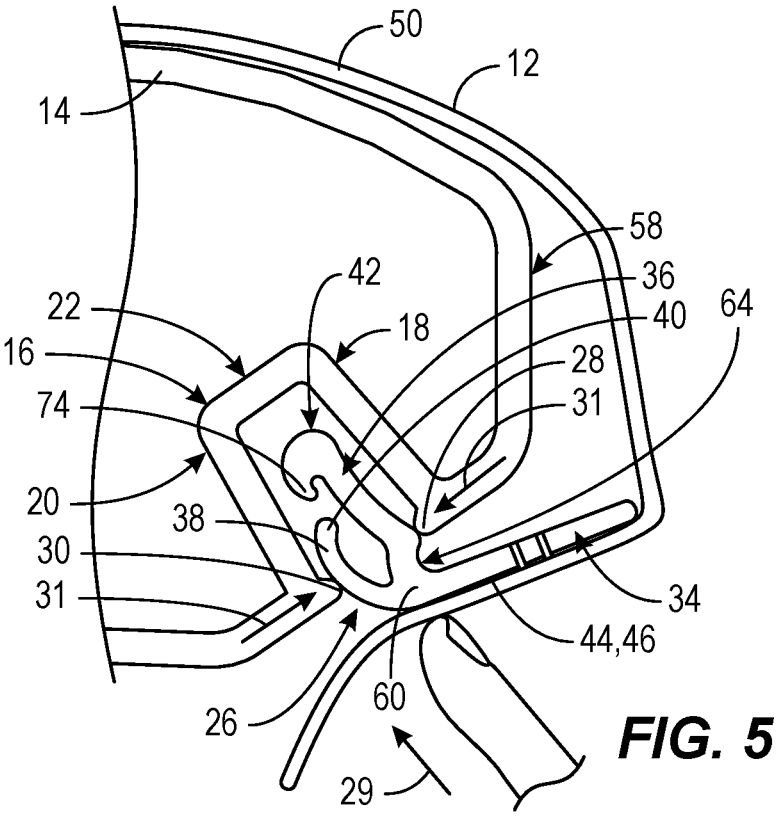
FIG. 5 is a side view of the retainer clip and cover as the retainer clip is further inserted into the channel.
Figure 6:
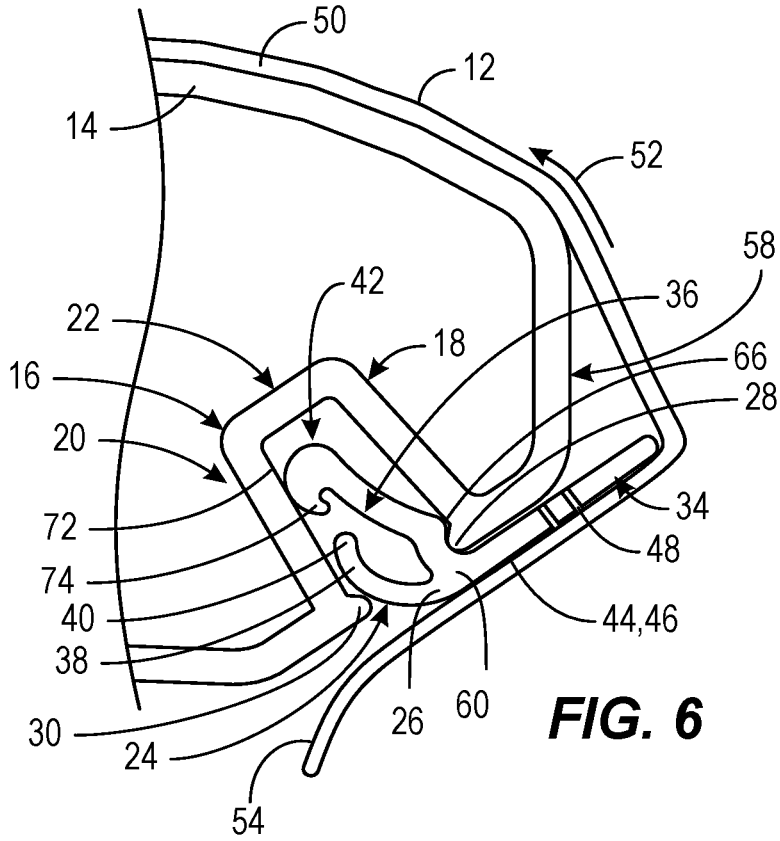
FIG. 6 is a side view of the retainer clip and cover once the retainer clip fully inserted into the channel, thereby coupling the cover is to the marine vessel.

FIGS. 4-6 illustrate the sequence for engaging the retainer clip 26 with the track member 14 to thereby attach the cover 12 to the marine vessel 10. As apparent from a comparison of FIGS. 4 and 5, the retainer clip 26 is manually inserted into the channel 16 by positioning the distal leg 36 into the mouth 24 and pressing down in the direction of arrow 29 in FIG. 5 on the cover 12 along a transition portion 60 of the body 32 between the proximal and distal legs 34, 36. The intermediate arm 38 is manually compressible towards the distal leg 36 so as to facilitate easier insertion of the retainer clip 26 into the channel 16. As the distal leg 36 is pressed into the channel 16, the inwardly curved intermediate arm 38 becomes manually pinched towards the distal leg 36, as shown by arrows 31 in FIG. 5, so that the free end 40 of the intermediate arm 38 moves closer to the distal leg 36 and fits in between the retaining tabs 28, 30 on the mouth 24. The inwardly curved profile of the intermediate arm 38 facilitates this pinching functionality of the intermediate arm 38 towards the distal arm 36. Once the free end 40 of the intermediate arm 38 and curved outer profile of the intermediate arm 38 are fully inserted into the channel 16 past the retaining tabs 28, 30, the intermediate arm 38 can be released, which allows a natural resiliency of the intermediate arm 38 to cause the intermediate arm 38 to spring back (i.e., snap back) into the position shown in the figures, which optionally can provide an audible click alerting the operator that the retainer clip 26 has been fully inserted into the channel 16. As the distal leg 36 is pressed downwardly into the channel 16, a recess 64 located along the transition portion 60 and between the proximal leg 34 and the distal leg 36 receives the thus mates with the retaining tab 28 on the proximal sidewall 18. A shoulder 66 located between the recess 64 and the distal leg 36 engages with a transition surface between the proximal sidewall 18 and the retaining tab 28 on the proximal sidewall 18.

Once the cover 12 is pulled tight across the marine vessel 10, for example by securing similar retainer clips to the track member 14 on an opposite side of the marine vessel 10, a secure engagement between the retainer clip 26 and channel 16 is facilitated. As apparent from a comparison of FIGS. 5 and 6, tensioning the cover 12 in the first tension direction 52 across the marine vessel 10, and particularly across the track member 14, and particularly tensioning the proximal leg 34 in the first tension direction 52 (see FIG. 6), causes the distal leg 36 to pivot in the channel 16 in a first pivot direction which in the views of FIGS. 5 and 6 is a counter-clockwise direction. This causes the distal leg 36 to engage the distal sidewall 20 and thus securely retain the retainer clip 26 in the channel 16. Thus the retainer clip 26 is configured to pivot about the retaining tab 28 on the proximal sidewall 18 when the distal leg 36 is inserted into the channel 16 and the proximal leg 34 is tensioned in the first tension direction 52. As mentioned above, the pivoting action is facilitated by mating of the retaining tab 28 and recess 64, and by engagement between the shoulder 66 on the retainer clip 26 and the noted transition surface between the proximal sidewall 18 and the retaining tab 28.

Referring to FIG. 6, the distal sidewall 20 includes a contiguous flat surface 72 between the closed inner end wall 22 and the mouth 24, and the distal leg 36 abuts only the contiguous flat surface 72 as it retains the retainer clip 26 in the channel 16. The distal leg 36 remains spaced apart from the retaining tab 30 on the distal sidewall 20 and abuts the distal sidewall 20 only at a location that is spaced apart from the retaining tab 30. The outer profile surface of the hook 42 abuts the distal sidewall 20 when the distal leg 36 is inserted into the channel 16 and the proximal leg 34 is tensioned in the first tension direction 52. The hook 42 has a free end 74 that is compressed towards the main body of the distal leg 36 when the retainer clip 26 is tensioned in the first tension direction 52.

Figure 7:
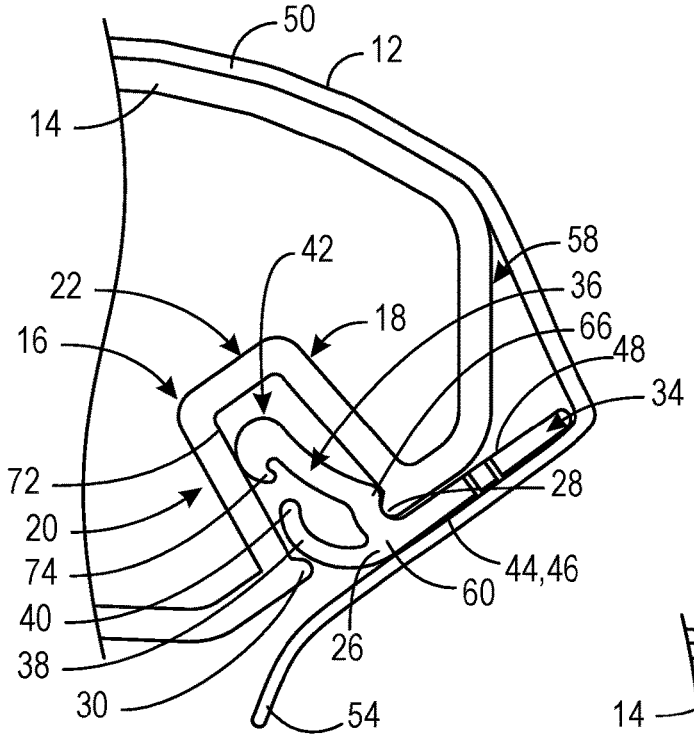
FIG. 7 is a view like FIG. 6.

FIGS. 7-9 illustrate the sequence for removing the retainer clip 26 from the track member 14, thus uncoupling the cover 12 from the marine vessel 10. As apparent by comparison of FIGS. 7 and 8, in an un-tensioned state, the overall width of the distal leg 36 and intermediate arm 38 is wider than the distance between the retaining tabs 28, 30, thus loosely retaining the retainer clip 26 in the channel 16. The retainer clip 26 can be manually removed from the track member 14 by tensioning the proximal leg 34 in the opposite, second directions 56 (see FIG. 10), which causes the distal leg 36 to pivot in an opposite, second pivot direction 76, i.e., clockwise in the figures. This disengages the distal leg 36 from the distal sidewall 20 so as to allow the retainer clip 26 to be removed from the channel 16. Tensioning the proximal leg 34 in the second direction 56 can be done by either or both of pulling on the flap 54 in the noted second direction 56 and/or grasping and rotating the proximal leg 34 away from the curved outer profile surface 58, clockwise in the figures. Either or both of these actions facilitates removal of the distal leg 36 and intermediate arm 38 from of the channel 16.

As apparent by comparison of FIGS. 8 and 9, pulling (tensioning) the proximal leg 34 in the direction shown causes the intermediate arm 38 and distal leg 36 out of the channel 16 to become pinched between the retaining tabs 28, 30, as shown at arrows 51, which thereby compresses the intermediate arm 38 towards the distal leg 36, thus facilitating removal of the retainer clip 26 from the channel 16. FIG. 10 illustrates the retainer clip 26 after the outer profile of the intermediate arm 38 has passed by the retaining tabs 28, 30 and which allows the intermediate arm 38 to spring back into its original form under the force of its own natural resiliency, optionally providing an audible clicking sound to alert the operator that the resilient clip 26 has been successfully disengaged from the channel 16.

The present disclosure thus provides an inventive retainer clip for attaching a cover to a marine vessel. According to examples disclosed herein, the retainer clip has an elongated body having a proximal leg configured for attachment to the cover and an opposite distal leg configured for insertion into a channel of a gunwale track member on the marine vessel; a hook on the distal arm, wherein the hook has an outer profile surface configured for engagement with the channel of the gunwale track member, the hook having a free end that is compressible towards the distal arm; and an intermediate arm extending from the body between the distal and proximal legs, the intermediate arm being configured for insertion into the channel along with the distal leg, wherein the intermediate arm has a free end that is manually compressible towards the distal leg so as to facilitate insertion and removal of the retaining clip into the channel.

In the present description, certain terms have been used for brevity, clearness and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

What is claimed is:

1. An apparatus for attaching a cover to a marine vessel, the apparatus comprising:

a retainer clip configured for attachment to the cover; and a track member configured for attachment to the marine vessel, the track member comprising a channel that retains the retainer clip to thereby attach the cover to the marine vessel, the channel comprising opposing proximal and distal sidewalls, a closed inner end, and an open outer end defining a mouth for receiving the retainer clip;

wherein the retainer clip comprises an elongated body having a proximal leg configured for attachment to the cover and an opposite distal leg configured for insertion into the channel; and wherein tensioning the proximal leg in a first tension direction causes the distal leg to pivot in the channel in a first pivot direction and engage with the distal sidewall so as to retain the retainer clip in the channel, and wherein tensioning the proximal leg in an opposite, second direction causes the distal leg to pivot in the channel in an opposite, second pivot direction and disengage from the distal sidewall so as to allow the retainer clip to be removed from the channel.

2. The apparatus according to claim 1, wherein the track member further comprises a retaining tab on the proximal sidewall, the retaining tab extending into the mouth; and wherein the retainer clip further comprises a recess between the proximal leg and distal leg, the recess being configured to mate with the retaining tab when the distal leg is inserted into the channel and the proximal leg is tensioned in the first tension direction.

3. The apparatus according to claim 2, wherein the retainer clip is configured to pivot about the retaining tab when the distal leg is inserted into the channel and the proximal leg is tensioned in the first tension direction.

4. The apparatus according to claim 2, wherein the retainer clip further comprises a shoulder between the recess and the distal leg, the shoulder being configured to engage with a transition surface between the proximal sidewall and the retaining tab on the proximal sidewall when the distal leg is inserted into the channel and the proximal leg is tensioned in the first tension direction.

5. The apparatus according to claim 1, wherein the distal sidewall comprises a contiguous flat surface located between the closed inner end and open outer end, and wherein the distal leg abuts only the contiguous flat surface to thereby retain the retainer clip in the channel.

6. The apparatus according to claim 1, wherein the track member further comprises a retaining tab on the distal sidewall, the retaining tab extending into the mouth towards the retaining tab on the proximal sidewall.

7. The apparatus according to claim 6, wherein when the distal leg is inserted into the channel and the proximal leg is tensioned in the first tension direction, the distal leg abuts the distal sidewall only at a location that is spaced apart from the retaining tab on the distal sidewall.

8. The apparatus according to claim 6, wherein when the distal leg is inserted into the channel and the proximal leg is tensioned in the first tension direction, the retaining clip remains spaced apart from the retaining tab on the distal sidewall.

9. The apparatus according to claim 6, wherein the retaining clip further comprises an intermediate arm extending from the body between the distal and proximal legs, the intermediate arm being configured for insertion into the channel along with the distal leg.

10. The apparatus according to claim 9, wherein the intermediate arm is manually compressible towards the distal leg so as to facilitate insertion and removal of the retainer clip into the channel.

11. The apparatus according to claim 10, wherein tensioning the proximal leg in the opposite, second direction causes the intermediate arm and distal leg to become pinched between the retaining tabs on the proximal and distal sidewalls, which thereby compresses the intermediate arm towards the distal leg, and thus facilitates removal of the retainer clip from the channel.

12. The apparatus according to claim 11, wherein the intermediate arm is curved inwardly towards the distal leg and has a free end that is spaced apart from the distal leg.

13. The apparatus according to claim 1, further comprising a hook on the distal leg of the retainer clip, the hook having an outer profile surface that abuts the distal sidewall when the distal leg is inserted into the channel and the proximal leg is tensioned in the first tension direction.

14. The apparatus according to claim 13, wherein the hook comprises a free end that is compressed towards the distal leg when the distal leg is inserted into the channel and the proximal leg is tensioned in the first tension direction.

15. The apparatus according to claim 1, wherein the proximal and distal legs extend relative to each other at an obtuse angle.

16. The apparatus according to claim 1, further comprising the cover.

17. The apparatus according to claim 16, wherein the cover is attached to the proximal leg and has a main portion extending away from the proximal leg in the first tension direction.

18. The apparatus according to claim 17, wherein the track member has a curved outer profile surface extending away from the proximal sidewall, and wherein the main portion of the cover is wrapped around the curved outer profile.

19. The apparatus according to claim 18, wherein the cover further comprises a flap extending away from the proximal leg, the flap facilitating removal of the retainer clip from the channel when the flap is manually pulled in the second direction.

20. A retainer clip for attaching a cover to a marine vessel, the retainer clip comprising:

an elongated body having a proximal leg configured for attachment to the cover and an opposite distal leg configured for insertion into a channel of a gunwale track member on the marine vessel;

a hook on the distal leg, wherein the hook has an outer profile surface configured for engagement with the channel of the gunwale track member, the hook having a free end that is compressible towards the distal arm; and an intermediate arm extending from the body between the distal and proximal legs, the intermediate arm being configured for insertion into the channel along with the distal leg, wherein the intermediate arm has a free end that is manually compressible towards the distal leg so as to facilitate insertion and removal of the retaining clip into the channel.

* * * * *